US009636881B2

(12) United States Patent
Foppe

(10) Patent No.: US 9,636,881 B2
(45) Date of Patent: May 2, 2017

(54) BLOCK MACHINE WITH LINEAR GUIDED SUPPORTING MEMBER

(75) Inventor: Norbert Foppe, Spelle (DE)

(73) Assignee: Rekers Verwaltungs-GmbH & Co. KG, Spelle (DE)

( * ) Notice: Subject to any disclaimer, the term of this patent is extended or adjusted under 35 U.S.C. 154(b) by 410 days.

(21) Appl. No.: 14/125,057

(22) PCT Filed: Jun. 4, 2012

(86) PCT No.: PCT/EP2012/060516
§ 371 (c)(1),
(2), (4) Date: Mar. 7, 2014

(87) PCT Pub. No.: WO2012/168193
PCT Pub. Date: Dec. 13, 2012

(65) Prior Publication Data

US 2014/0377399 A1 Dec. 25, 2014

(30) Foreign Application Priority Data

Jun. 9, 2011 (DE) ..... 10 2011 050 971

(51) Int. Cl.
*B30B 15/04* (2006.01)
*B30B 15/08* (2006.01)
*B28B 3/02* (2006.01)

(52) U.S. Cl.
CPC ..... *B30B 15/041* (2013.01); *B28B 3/02* (2013.01); *B30B 15/045* (2013.01)

(58) Field of Classification Search
CPC ..... B30B 15/041; B30B 15/045; B28B 3/02
(Continued)

(56) References Cited

U.S. PATENT DOCUMENTS 4,063,866 A * 12/1977 Lurbiecki ..... B28B 11/04 425/424
4,233,006 A * 11/1980 Panas ..... B29C 67/222 264/51

(Continued)

FOREIGN PATENT DOCUMENTS

DE 7202076 2/1973
DE 19506519 8/1996

OTHER PUBLICATIONS

International Search Report, mailing date Oct. 1, 2012 for corresponding International Application No. PCT/EP2012/060516 with English translation.

(Continued)

*Primary Examiner* — Joseph S Del Sole
*Assistant Examiner* — Thukhanh T Nguyen
(74) *Attorney, Agent, or Firm* — Intellectual Property Law Group LLP

(57) ABSTRACT

The present invention relates to a block machine (1) with a machine bed (2, 3) at which at least one lifting device (4, 5) for a supporting member (6, 7) is arranged. The supporting member (6, 7) is movably supported on the machine bed (2, 3) via a linear guide which has at least one longitudinal guiding member (8*a*, 8*b*, 9*a*, 9*b*) and a guiding means (10, 11, 12, 13, 14, 15) interacting therewith. To the supporting member (6, 7) there is attached a first longitudinal guiding member (8*a*, 8*b*) that is movably supported via at least one bed guiding means (10, 11, 12, 13) that is arranged at the machine bed (2, 3). At the machine bed (2, 3) a second longitudinal guiding member (9*a*, 9*b*) is arranged on which the supporting member (6, 7) is movably supported by a supporting member guiding means (14, 15) arranged thereon.

19 Claims, 5 Drawing Sheets

(58) Field of Classification Search
USPC ..... 425/253–255, 258–259, 352–355, 408, 425/412, 414, 423, 451.9; 249/211, 213, 249/216–217, 190–194
See application file for complete search history.

(56) References Cited

U.S. PATENT DOCUMENTS

| | | | | |
|---|---|---|---|---|
| 4,238,177 | A * | 12/1980 | Crile | B28B 1/081 264/71 |
| 4,725,214 | A | 2/1988 | Piazza et al. | |
| 7,217,118 | B2 * | 5/2007 | Womack | B28B 3/02 249/190 |
| 7,229,263 | B2 * | 6/2007 | Silbermann | B30B 11/02 425/412 |

OTHER PUBLICATIONS

International Preliminary Examination Report, mailing date Jun. 28, 2013 for corresponding International Application No. PCT/EP2012/060516.

* cited by examiner

BLOCK MACHINE WITH LINEAR GUIDED SUPPORTING MEMBER

CROSS-REFERENCE TO RELATED APPLICATIONS

This application is a U.S. National Phase application, under 35 U.S.C. §371, of International Application no. PCT/EP2012/060516, with an international filing date of Jun. 4, 2012, and claims benefit of German Application no. 10 2011 050 971.2 filed on Jun. 9, 2011, and which are hereby incorporated by reference for all purposes.

FIELD OF THE INVENTION

The present invention relates to a block machine with a machine bed at which at least one lifting device for a supporting member is arranged, wherein the supporting member is movably supported on the machine bed via a linear guide that has at least one longitudinal guiding member and a guiding means interacting therewith.

BACKGROUND

Block machines are known in the prior art in various embodiments. Substantially, in a synchronized process a stone mould should be provided, a concrete mixture should be filled into the moulding cavities of the stone mould, the concrete mixture should be packed with a tamper and/or a vibrator, and subsequently the thus produced final concrete products, the so-called moulded articles, should be demoulded.

Here, it has been proven successful to charge the block machines with bolster pallets and to lower stone moulds onto the bolster pallets. In general, the stone mould is formed as an upwards and downwards open mould.

The concrete mixture is then filled from at least one concrete hopper into at least one feedbox and let from there into the mould cavities of the stone mould. Subsequently, the bolster pallet is moved with a vibration unit and/or the tamper is lowered into the stone mould onto the fresh concrete. In this way, the concrete is packed in the stone mould. In the next step the tamper and the stone mould are lifted again and the bolster pallet with the moulded articles is taken out of the block machine.

In order to move the movable members such as the stone mould or the tamper such block machines nowadays have at least one lifting device such as a hydraulic cylinder. This often acts via at least one supporting member on the member to be lifted such as a stone mould or a tamper.

The supporting member can be configured as a traverse. Typically, it is guided via a linear guide on longitudinal guiding members, for example on shafts. For that, it has at least one guiding means interacting with the longitudinal guiding member, for example a slide bearing, a bushing, or the like.

It has shown in the past that especially the heavy movable members such as the stone mould or the tamper tend to tilt or jam in their guides. By such a tilting for example the wearing of the bearings is reduced which in turn leads to higher operating times of the machine.

In order to substantially avoid such problems the employment of specific lifting devices for the supporting members has proven successful. Said lifting devices often consist of a drive that moves a balancing swing arm fixed on the upper side of the machine bed such that the supporting member connected with the swing arm via a interconnecting bar is moved vertically along the longitudinal guides. For the most part in the prior art two lifting devices each per supporting member laterally arranged on the machine bed are used.

However, this solution known from the prior art requires a number of movable parts and respective bearings as well as two drives per supporting member what on the one hand significantly increases the production and first costs for the block machine and the associated maintenance and repair costs. On the other hand, the construction and design of such a machine is relatively expensive and it results in a high space required for the individual components.

SUMMARY OF THE INVENTION

Against this background, it is the object of the invention to provide a block machine that with the same quality of the guide of the at least one movable part is simpler in its construction and can be produced at lower costs.

The solution of the problem is achieved with the block machine according to claim 1. Advantageous developments of the invention are described in the dependent claims.

The block machine according to the invention differs from the initially described block machines in that a first longitudinal guiding member is attached to the supporting member. The first longitudinal guiding member is movably supported via a bed guiding means arranged on the machine bed. At the machine bed a second longitudinal guiding member is arranged on which the supporting member is movably supported via a supporting member guiding means arranged thereon.

This has the advantage that up to now the guiding members are not on the same height in the guiding direction, but are arranged spaced apart in the guiding direction. This is based on the idea to use the total height of the block machine to achieve a wide spread of the bearing of the corresponding supporting member. With the now presented solution also in an extreme position of the supporting member, for example completely lifted, it is possible to define a distance between the bed guiding means and the supporting member guiding means that at least corresponds to the thickness or height of the machine bed, respectively. Thus, the guiding points of the supporting member in the vertical direction are always spaced apart whereby the supporting member is spatially stabilized. Thus, a tilting in lowering or lifting the supporting member is avoided.

Therefore, a balancing swing arm and an interconnecting bar are no longer required, since the drive can directly act on the supporting member. Moreover, in this way also smaller guiding means can be used in building, since a long guiding way within the guiding means to stabilize the supporting member is not necessary.

Preferably, as at least one lifting device a mould lifting device for a mould supporting member and/or a tamper lifting device for a tamper supporting member is/are arranged on the machine bed.

Advantageously, the first longitudinal guiding member of the mould lifting device that is attached to the mould supporting member at the same time forms the second longitudinal guiding member of the tamper lifting device and/or the first longitudinal guiding member of the tamper lifting device that is attached to the tamper supporting member at the same time forms the second longitudinal guiding member of the mould lifting device. That is, the two different guides are fitted into each other. This saves components, since no specific guide and also no separate longitudinal guiding member must be provided for the tamper lifting device or the mould lifting device, respectively.

Advantageously, two first longitudinal guiding members are attached to the supporting member and/or two supporting member guiding means are arranged at the supporting member. Accordingly, the supporting member is guided with two longitudinal guiding members that in turn are movably supported on the machine bed via at least one bed guiding means. This results in at least two guiding points that are not on a horizontal plane with the guiding points of the supporting member guiding means. This enables a still better spatial stabilization of the supporting member in the guide.

Suitably, at the supporting member the two first longitudinal guiding members and/or the two supporting member guiding means are arranged diagonally opposite. This has the advantage that the supporting member spatially can also be better stabilized.

Further, it can be of advantage if two bed guiding means for a longitudinal guiding member are arranged at the machine bed. Thus, the longitudinal guiding member is guided at two spatially separated points in the bed. In this way, the longitudinal guiding member can bend even less, so that tilting of the supporting member can be avoided even safer, which in turn has a positive effect on the wearing of the guiding member and the guiding means.

It is advantageous if the at least one longitudinal guiding member is formed as shaft, rod, rail, or groove in a carrier of the machine bed. Moreover, it is advantageous if the at least one guiding means has a recess, bushing, cage riding, jaw guiding, spring, or rolling body to guide its assigned longitudinal guiding member.

Suitably, at least one first longitudinal guiding member is attached to the supporting member by means of a releasable locking means and at least one second longitudinal guiding member is guided on the machine frame by means of a lockable guiding means. So, the first longitudinal guiding member can be made to a second longitudinal guiding member by releasing the locking means and the second longitudinal guiding member can be made to a first longitudinal guiding member by locking the guiding means. Thus, the longitudinal guiding members of one supporting means can be exchanged for that of the other supporting means for example with signs of wear. Further, this also results in the opportunity to exchange individual longitudinal guiding members, for example in the course of service efforts without having to dismantle the block machine in a large extent. As the lockable guiding means a jaw guiding may be provided, for example.

BRIEF DESCRIPTION OF THE DRAWINGS

In the following the invention is explained in more detail with the help of an example shown in the drawings. Here.

DETAILED DESCRIPTION OF SPECIFIC EMBODIMENTS

Figure 1:
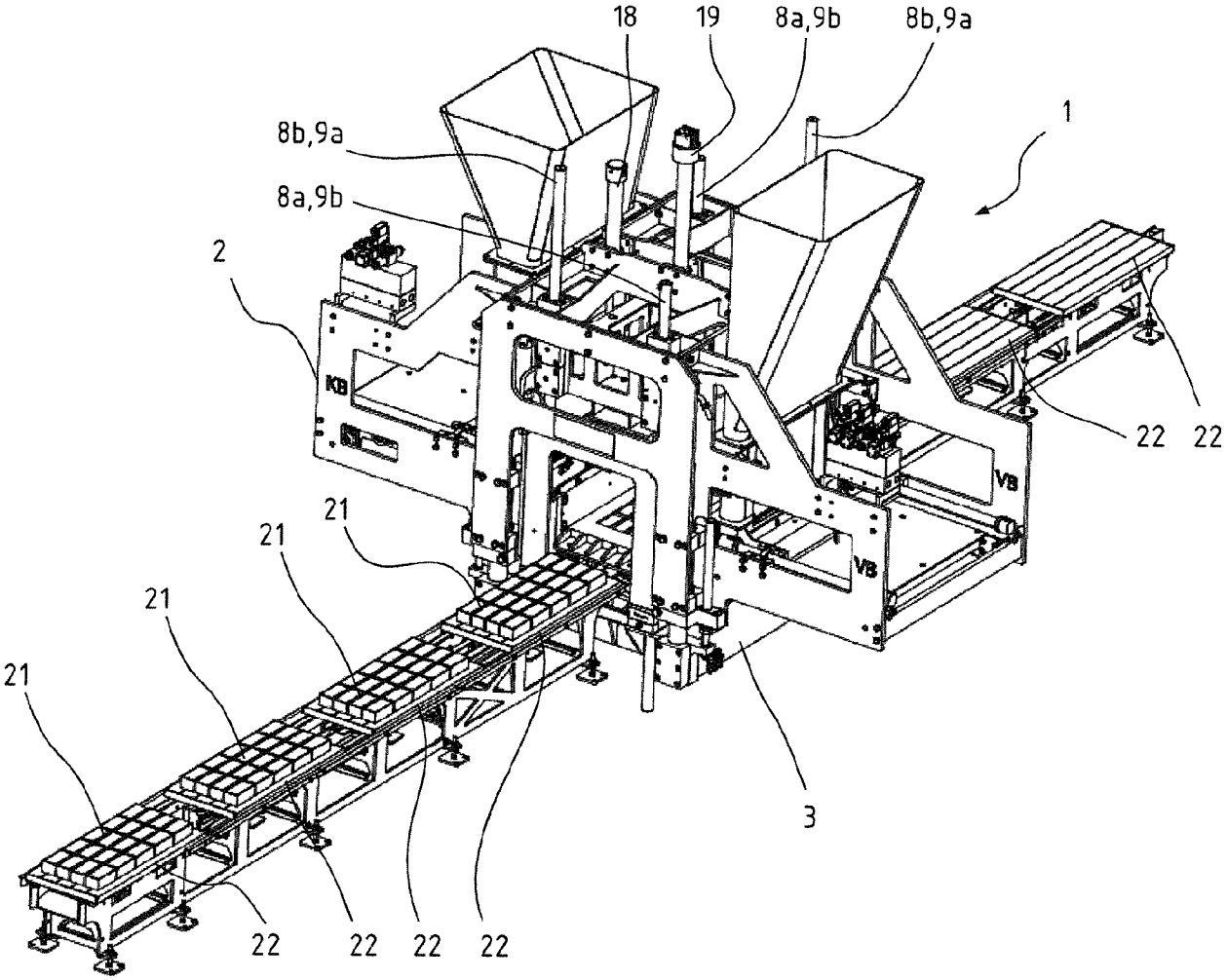
FIG. 1 schematically shows a perspective view of a block machine according to the invention.

In FIGS. 1 to 5 there is shown a block machine 1 according to the invention in several views and operating states. The block machine 1 has a machine bed 2, 3 with a movable main frame 2 and a static frame 3. A mould lifting device 4 and a tamper lifting device 5 are arranged at the movable frame 2. With the mould lifting device 4 and the tamper lifting device 5 a mould supporting member 6 and a tamper supporting member 7, respectively, are movably supported on the machine bed 2, 3 via linear guides. For that, in the block machine according to the invention there are used shaft guides with other types of linear guides also being applicable.

As can be seen in particular in FIG. 1, the linear guide of the mould supporting member 6 includes two first longitudinal guiding members 8*a* and two second longitudinal guiding members 9*a* which are diagonally opposite on the machine bed 2, 3. The same applies to the linear guide of the tamper supporting member 7 that also includes two first longitudinal guiding members 8*b* and two second longitudinal guiding members 9*b*, with the first longitudinal guiding members 8*b* of the tamper supporting member 7 corresponding to the second longitudinal guiding members 9*a* of the mould supporting member 6 and vice verse. For simplicity, the linear guides now are explained in more detail with reference to only one first longitudinal guiding member 8*a*, 8*b* and one second longitudinal guiding member 9*a*, 9*b* each.

As illustrated in the sectional views of FIGS. 2 to 5, the first longitudinal guiding member 8*a* of the mould supporting member 6 is attached thereto via a releasable locking means 16, for example via a lockable jaw guiding. The mould supporting member 6 is guided via a supporting member guiding means 14 at the second longitudinal guiding member 9*a* of the mould supporting member 6, wherein the supporting member guiding means 14 can be designed for example as lockable jaw guiding or as a slide bearing.

The linear guide of the tamper supporting member 7 has lockable guiding means 17 to which the first longitudinal guiding member 8*b* of the tamper supporting member 7 is attacked. For example, the releasable locking means 17 can be a lockable jaw guiding. The tamper supporting member 7 is guided at the second longitudinal guiding member 9*b* of the tamper supporting member 7 via a supporting member guiding means 15 that also can be designed as a lockable jaw guiding or as a slide bearing, for example.

The first longitudinal guiding member 8*a*, 8*b* and the second longitudinal guiding member 9*a*, 9*b* of the mould supporting member 6 and the tamper supporting member 7, respectively, are guided in two bed guiding means 10, 11, 12, 13 each. For example, these bed guiding means 10, 11, 12, 13 can be designed as slide bearing. The upper bed guiding means 10, 11 are arranged at the movable frame 2 and the lower bed guiding means 12, 13 are arranged at the static frame 3. As can be seen from FIGS. 2 to 5, the bed guiding means 10, 11, 12, 13 are always spaced apart from the supporting member guiding means 14, 15 and the releasable locking means 16, 17, respectively. This not only results in guiding points for guiding the mould supporting member 6 and the tamper supporting member 7, respectively, that are substantially arranged on one height, but also guiding points that are arranged vertically spaced apart. Thus, in the guiding direction (here, in the vertical direction) there is a wide spread of the bearing or guiding, respectively, of the mould supporting member 6 and the tamper supporting member 7, respectively, by utilizing the total height of the block machine 1.

For moving the mould supporting member 6 the mould lifting device 4 has two mould lifting cylinders 18 directly acting on the mould supporting member 6. The mould lifting cylinders 18 each are laterally arranged at the movable frame 2 of the block machine 1 between a first longitudinal guiding member 8*a* and a second longitudinal guiding member 9*a* of the mould supporting member 6, as can be seen in particular in FIG. 1.

For moving the tamper supporting member 7 the tamper lifting device 5 has a tamper lifting cylinder 19 that is centrally arranged at the movable frame 2 of the block machine 1, wherein the tamper lifting cylinder 19 directly acts on the tamper supporting member 7. Since by the movement of the tamper supporting member 7 also the first longitudinal guiding members 8*b* are moved two recesses 20 are below the static frame 3 into which the first longitudinal guiding members 8*b* protrude with the tamper supporting member 7 being lowered (see, FIGS. 4 and 5). However, it is also quite possible to choose the height of the static frame 3 such that the recesses 20 can be omitted.

In the following now with reference to an example the production of the moulded articles 21 with a block machine 1 according to the invention and the corresponding movements of the mould supporting member 6 and the tamper supporting member 7, respectively, are described.

Figure 2:
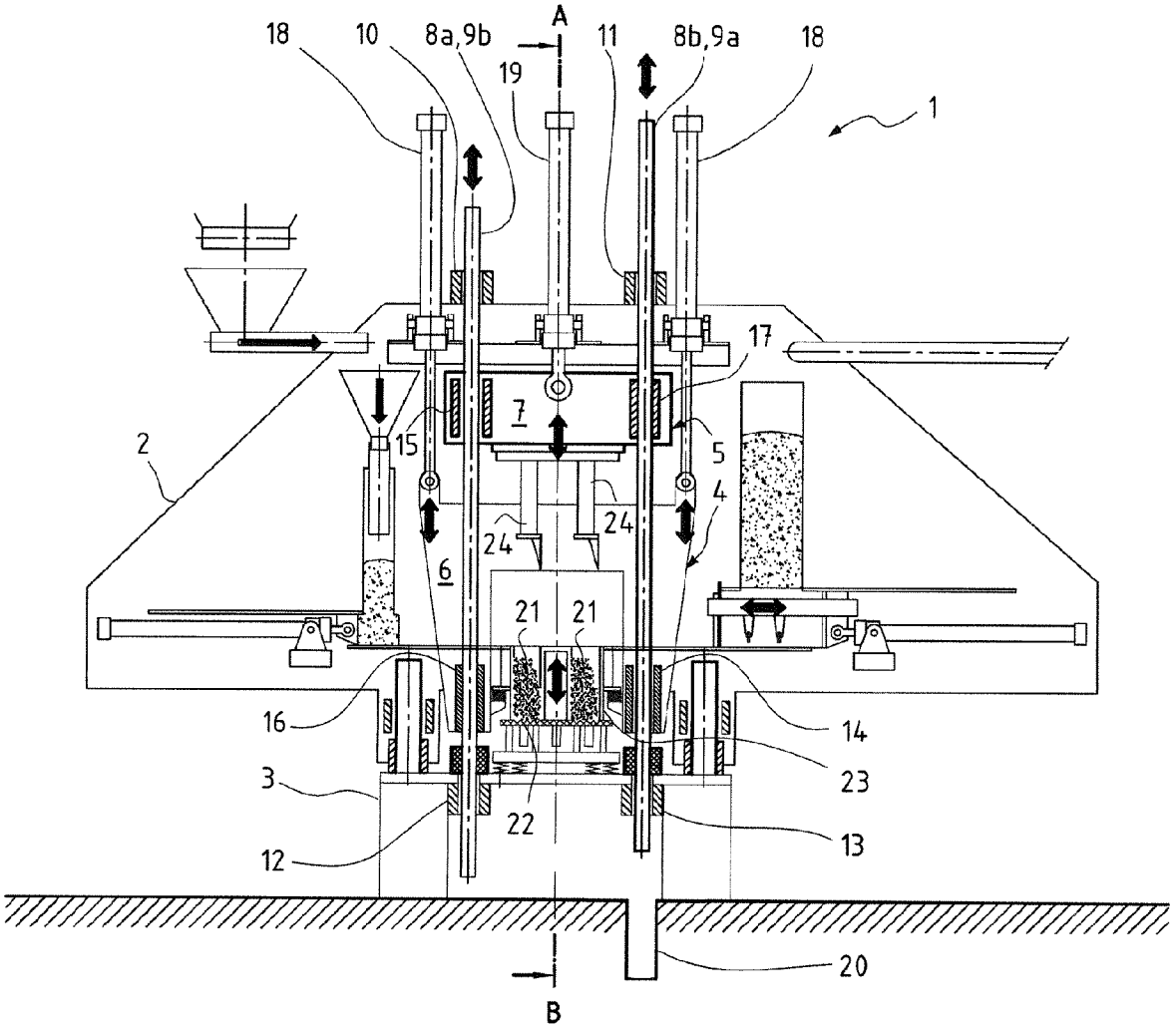
FIG. 2 schematically shows a cross-section through the block machine according to the invention with the tamper supporting member being lifted.
Figure 3:
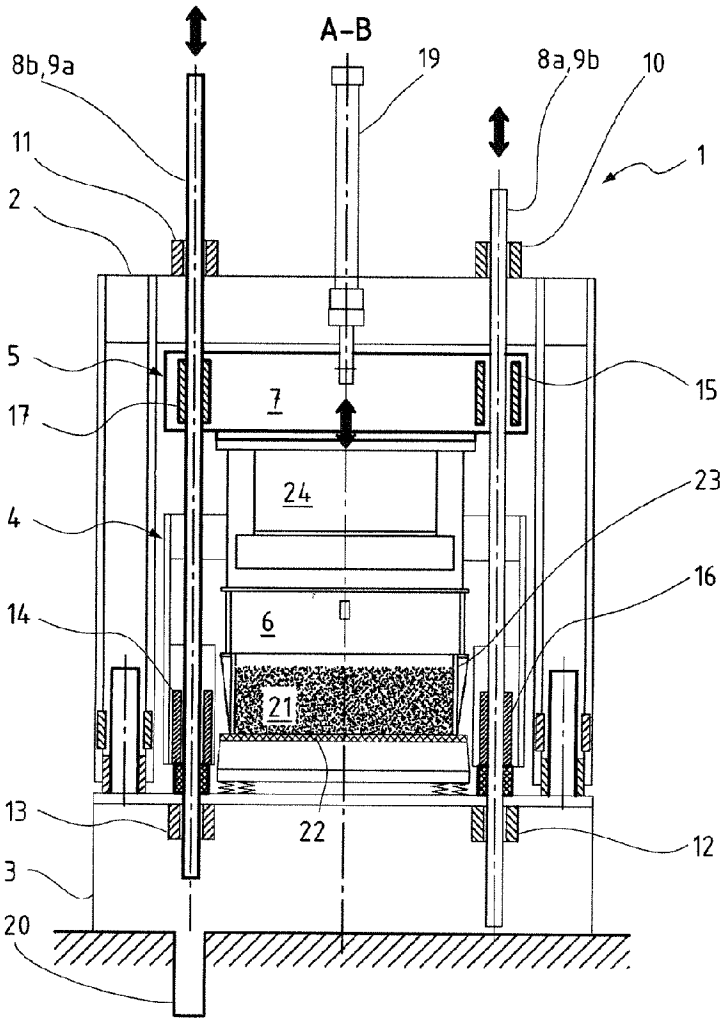
FIG. 3 schematically shows the sectional view indicated in FIG. 2 along line A-B.

First, the block machine 1 is fed with a bolster pallet 22. The bolster pallet 22 stops centrally in the block machine 1, often on a vibrator table unit. Subsequently, an upwards and downwards open stone mould 23 is lowered onto the bolster pallet 22. For that, the stone mould 23 is attached to the mould supporting member 6. By actuating the mould lifting cylinder 18 the mould supporting member 6 is lowered. Here, also the first longitudinal guiding members 8*a* are moved, since these are attached to the mould supporting member 6 via the releasable locking means 16. The second longitudinal guiding members 9*a* do not move, with the mould supporting member 6 being guided thereon by means of the guiding means 14. Subsequently, concrete is filled into the mould cavities of the stone mould 23 via feedboxes. This state with filled mould cavities of the stone mould 23 is illustrated in FIGS. 2 and 3.

Figure 4:
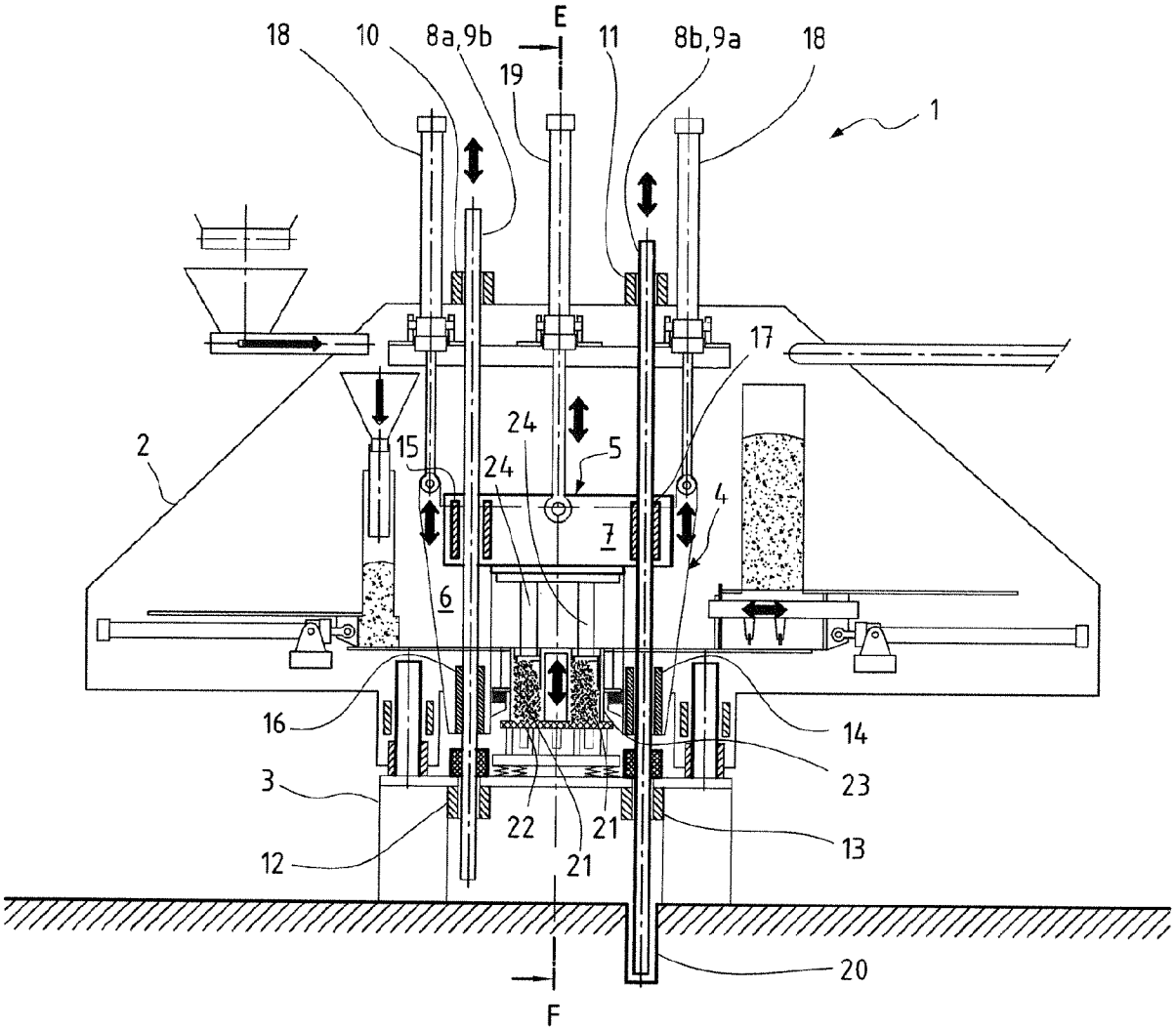
FIG. 4 schematically shows the cross-section of the block machine according to the invention shown in FIG. 2 with the tamper supporting member being lowered.
Figure 5:
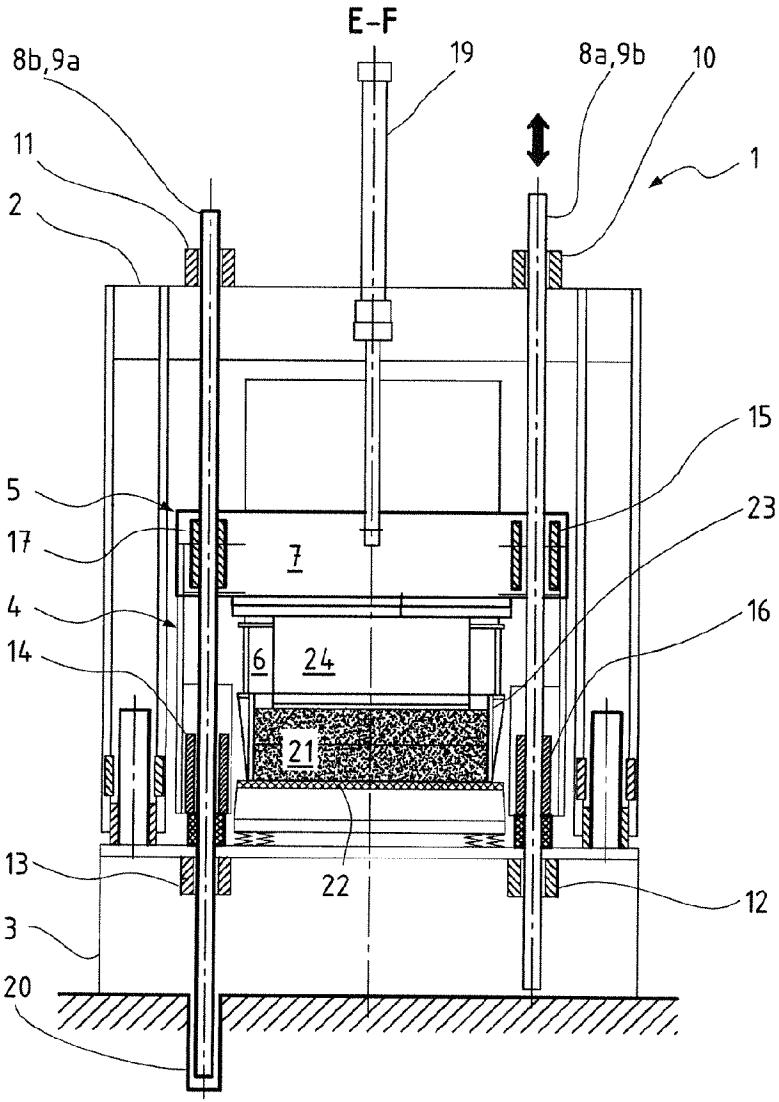
FIG. 5 schematically shows the sectional view indicated in FIG. 4 along line E-F.

After the stone mould 23 has been filled, the tamper supporting member 7 is lowered, so that the tampers 24 attached to the tamper supporting member 7 pack the concrete in the stone mould 23. Additionally, but also alternatively, packing the concrete can be performed by vertical excitation by means of the vibrating table unit. The movement of the tamper supporting member 7 is performed by actuating the tamper lifting cylinder 19. Since the first longitudinal guiding members 8*b*, which at the same time are the second longitudinal guiding members 9*a* of the mould supporting member 6, are attached to the tamper supporting member 7 via the releasable locking means 17 they are also moved with the movement of the tamper supporting member 7. Here, the second longitudinal guiding members 9*b*, which at the same time are the first longitudinal guiding members 8*a* of the mould supporting member 6, are not moved, since the tamper supporting member 7 is movably supported thereon via the guiding means 15. When the tamper supporting member 7 is completely lowered and the tampers 24 have packed the concrete in the mould cavities of the stone mould 23, the lower ends of the first longitudinal guiding member 8*b* of the tamper supporting member 7 protrude into the recesses 20. This state is illustrated in FIGS. 4 and 5.

Then, first the tamper supporting member 7 is lifted again, wherein also the first longitudinal guiding members 8*b* of the tamper supporting member 7 are moved again. Subsequently, the stone mould 23 is lifted from the bolster pallet 22 by lifting the mould supporting member 6, and the moulded articles 21 are removed. Here, also the first longitudinal guiding members 8*a* of the mould supporting member 6 are moved again. Then, the bolster pallet 22 with the moulded articles 21 can be taken out of the block machine 1 and supplied to the subsequent processes.

REFERENCE NUMBERS

1 Block Machine
2 Movable Main Frame
3 Static Frame
4 Mould Lifting Device
5 Tamper Lifting Device
6 Mould Supporting Member
7 Tamper Supporting Member
8*a* First Longitudinal Guiding Member of the Mould Supporting Members
8*b* First Longitudinal Guiding Member of the Tamper Supporting Members
9*a* Second Longitudinal Guiding Member of the Mould Supporting Members
9*b* Second Longitudinal Guiding Member of the Tamper Supporting Members
10 Upper Bed Guiding Means
11 Upper Bed Guiding Means
12 Lower Bed Guiding Means
13 Lower Bed Guiding Means
14 Supporting Member Guiding Means
15 Supporting Member Guiding Means
16 Releasable Locking Means
17 Releasable Locking Means
18 Mould Lifting Cylinder
19 Tamper Lifting Cylinder
20 Recess
21 Moulded Articles
22 Bolster Pallet
23 Stone Mould
24 Tamper

What is claimed is:

1. A block machine (1) with a machine bed (2, 3) at which at least one lifting device (4, 5) for a supporting member (6, 7) is arranged, wherein the supporting member (6, 7) is movably supported on the machine bed (2, 3) by a linear guide having at least one longitudinal guiding member (8*a*, 8*b*, 9*a*, 9*b*) and a guiding means (10, 11, 12, 13, 14, 15) interacting therewith, characterized in that a first longitudinal guiding member (8*a*, 8*b*) by means of a releasable locking means (16, 17) is attached to the supporting member (6, 7), the first longitudinal guiding member is movably supported by at least one bed guiding means (10, 11, 12, 13) arranged on the machine bed (2, 3) and a second longitudinal guiding member (9*a*, 9*b*) is arranged on the machine bed (2, 3) on which the supporting member (6, 7) is movably supported by a supporting member guiding means (14, 15) arranged thereon;

wherein the second longitudinal guiding member (9*a*, 9*b*) by means of a lockable guiding means (14, 15) is guided on the machine frame (2,3) to be able to make the first longitudinal guiding member (8*a*, 8*b*) to a second longitudinal guiding member (9*a*, 9*b*) by releasing the locking means (16, 17) and to be able to make the second longitudinal guiding member (9*a*, 9*b*) to a first longitudinal guiding member (8*a*, 8*b*) by locking the guiding means (14, 15).

2. The block machine (1) according to claim 1, characterized in that as the at least one lifting device (4, 5) a mould lifting device (4) for a mould supporting member (6) and/or a tamper lifting device (5) for a tamper supporting member (7) is/are arranged on the machine bed (1).

3. The block machine (1) according to claim 2, characterized in that the first longitudinal guiding member (8*a*) of the mould lifting device (4) attached to the mould supporting member (6) at the same time forms the second longitudinal guiding member (9*b*) of the tamper lifting device (5) and/or the first longitudinal guiding member (8*b*) of the tamper lifting device (5) attached to the tamper supporting member (7) at the same time forms the second longitudinal guiding member (9*a*) of the mould lifting device (4).

4. The block machine (1) according to claim 2, characterized in that two first longitudinal guiding members (8*a*, 8*b*) are attached to and/or two supporting member guiding means (14, 15) are arranged at the supporting member (6, 7).

5. The block machine (1) according to claim 1, characterized in that the two first longitudinal guiding members (8*a*, 8*b*) and/or the two supporting member guiding means (14, 15) are arranged diagonally opposite at the supporting member (6, 7).

6. The block machine (1) according to claim 1 characterized in that two bed guiding means (10, 11, 12, 13) for a longitudinal guiding member (8*a*, 8*b*, 9*a*, 9*b*) are arranged at the machine bed (2, 3).

7. The block machine (1) according to claim 1, characterized in that at least one longitudinal guiding member (8*a*, 8*b*, 9*a*, 9*b*) is formed as a shaft, rod, rail, or groove in a carrier of the machine bed (2, 3).

8. The block machine (1) according to claim 1, characterized in that at least one guiding means (10, 11, 12, 13, 14, 15) has a recess, bushing, cage riding, jaw guiding, spring, or rolling body to guide its assigned longitudinal guiding member (8*a*, 8*b*, 9*a*, 9*b*).

9. The block machine (1) according to claim 2, characterized in that the two first longitudinal guiding members (8*a*, 8*b*) and/or the two supporting member guiding means (14, 15) are arranged diagonally opposite at the supporting member (6, 7).

10. The block machine (1) according to claim 3, characterized in that the two first longitudinal guiding members (8*a*, 8*b*) and/or the two supporting member guiding means (14, 15) are arranged diagonally opposite at the supporting member (6, 7).

11. The block machine (1) according to claim 4, characterized in that the two first longitudinal guiding members (8*a*, 8*b*) and/or the two supporting member guiding means (14, 15) are arranged diagonally opposite at the supporting member (6, 7).

12. The block machine (1) according to claim 2, characterized in that two bed guiding means (10, 11, 12, 13) for a longitudinal guiding member (8*a*, 8*b*, 9*a*, 9*b*) are arranged at the machine bed (2, 3).

13. The block machine (1) according to claim 3, characterized in that two bed guiding means (10, 11, 12, 13) for a longitudinal guiding member (8*a*, 8*b*, 9*a*, 9*b*) are arranged at the machine bed (2, 3).

14. The block machine (1) according to claim 4, characterized in that two bed guiding means (10, 11, 12, 13) for a longitudinal guiding member (8*a*, 8*b*, 9*a*, 9*b*) are arranged at the machine bed (2, 3).

15. The block machine (1) according to claim 2, characterized in that at least one longitudinal guiding member (8*a*, 8*b*, 9*a*, 9*b*) is formed as a shaft, rod, rail, or groove in a carrier of the machine bed (2, 3).

16. The block machine (1) according to claim 3, characterized in that at least one longitudinal guiding member (8*a*, 8*b*, 9*a*, 9*b*) is formed as a shaft, rod, rail, or groove in a carrier of the machine bed (2, 3).

17. The block machine (1) according to claim 4, characterized in that at least one longitudinal guiding member (8*a*, 8*b*, 9*a*, 9*b*) is formed as a shaft, rod, rail, or groove in a carrier of the machine bed (2, 3).

18. The block machine (1) according to claim 2, characterized in that at least one guiding means (10, 11, 12, 13, 14, 15) has a recess, bushing, cage riding, jaw guiding, spring, or rolling body to guide its assigned longitudinal guiding member (8*a*, 8*b*, 9*a*, 9*b*).

19. The block machine (1) according to claim 2, characterized in that at least one first longitudinal guiding member (8*a*, 8*b*) by means of a releasable locking means (16, 17) is attached to a supporting member (6, 7) and at least one second longitudinal guiding member (9*a*, 9*b*) by means of a lockable guiding means (14, 15) is guided on the machine frame (2, 3) to be able to make the first longitudinal guiding member (8*a*, 8*b*) to a second longitudinal guiding member (9*a*, 9*b*) by releasing the locking means (16, 17) and to be able to make the second longitudinal guiding member (9*a*, 9*b*) to a first longitudinal guiding member (8*a*, 8*b*) by locking the guiding means (14, 15).

* * * * *